US006325007B1

(12) United States Patent
Farmer

(10) Patent No.: US 6,325,007 B1
(45) Date of Patent: Dec. 4, 2001

(54) THREAD GUIDE ATTACHMENT FOR SEWING MACHINES

(76) Inventor: Bennie Farmer, 2012 S. Park View Dr., Pueblo, CO (US) 81006

( * ) Notice: Subject to any disclaimer, the term of this patent is extended or adjusted under 35 U.S.C. 154(b) by 0 days.

(21) Appl. No.: 09/618,148

(22) Filed: Jul. 17, 2000

(51) Int. Cl.[7] ..... D05B 47/00; D05B 29/12

(52) U.S. Cl. ..... 112/302; 112/240

(58) Field of Search ..... 112/235, 302, 112/240

(56) References Cited

U.S. PATENT DOCUMENTS

| | | | | |
|---|---|---|---|---|
| 2,137,454 | * | 11/1938 | Litsey | 112/235 |
| 2,211,333 | * | 8/1940 | Lang | 112/235 |
| 3,547,059 | * | 12/1970 | Dolney et al. | 112/235 |
| 5,690,040 | * | 11/1997 | Nakayama et al. | 112/235 |

* cited by examiner

*Primary Examiner*—Ismael Izaguirre
(74) *Attorney, Agent, or Firm*—Paul H. Gallagher

(57) ABSTRACT

A single-piece, integral article having spaced parallel, open end prongs frictionally fitted on the prongs of a conventional presser foot on a sewing machine. The article has a pin which, when the article is applied in place, is spaced horizontally from the needle in the sewing machine, and the sewing thread is wrapped around the pin and held from becoming entangled.

5 Claims, 1 Drawing Sheet

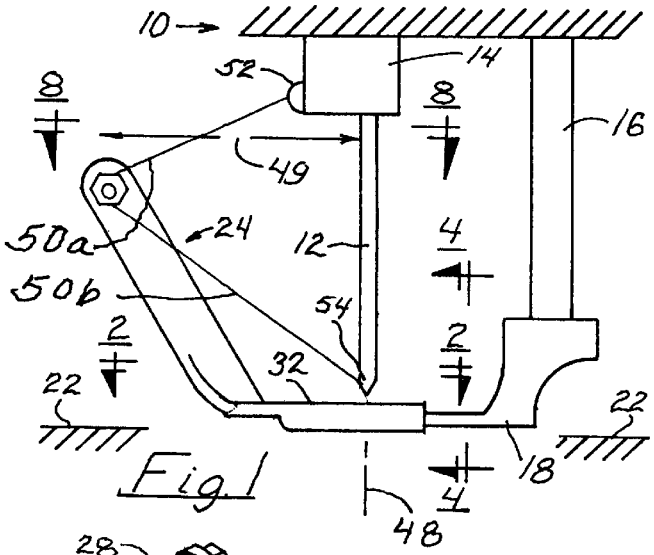
Fig. 1
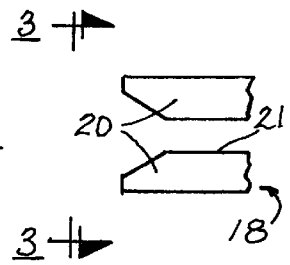
Fig. 2
Fig. 3
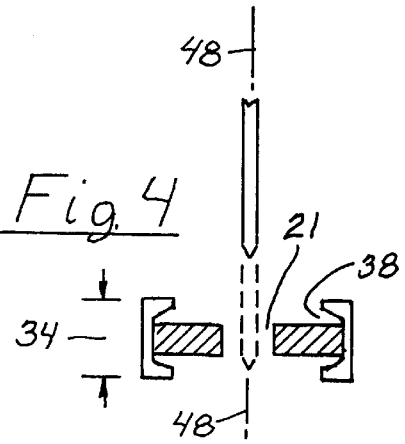
Fig. 4
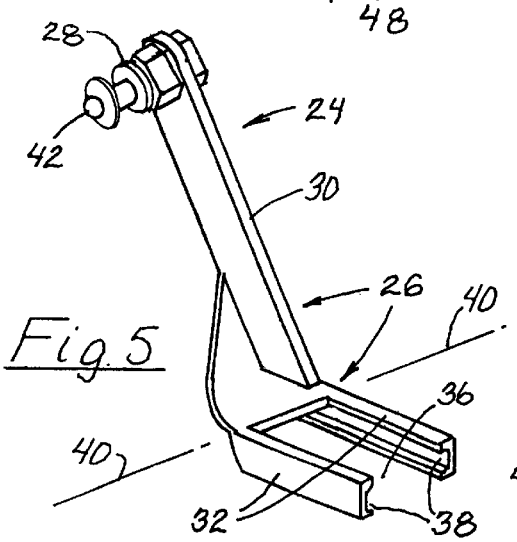
Fig. 5
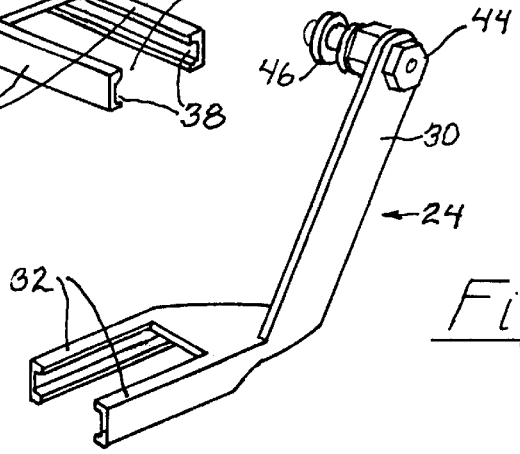
Fig. 6
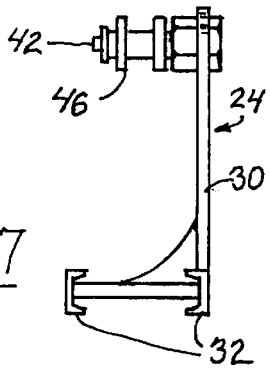
Fig. 7
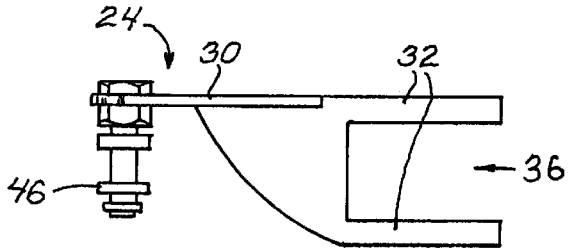
Fig. 8

THREAD GUIDE ATTACHMENT FOR SEWING MACHINES

FIELD OF THE INVENTION

The invention resides in the field of sewing machines where the thread tends to become knotted or tangled, and not run smoothly through the needle. Heretofore thread would often become knotted or entangled, either in association with the needle, or by itself. This was particularly true in the case of metallic thread. Metallic thread easily became knotted, as compared with other threads such as cotton, etc. with corresponding difficulties and annoyances so as to prevent the thread from running smoothly.

SUMMARY OF THE INVENTION

A main objective of the invention is to provide a guide to overcome the above objection, which can be easily applied to the sewing machine, and that does not require modification of the sewing machine itself to enable its application thereto.

The guide is so applied to the sewing machine by fitting it on the presser foot, which includes prongs extending generally horizontally, the guide having corresponding prongs fitted on those prongs.

Another object is to provide such a guide that is extremely simple and thereby easily applied to the presser foot of the sewing machine and held thereon mainly by the friction.

Still another object is to provide such a guide, whereby when it is applied to the sewing machine, and the thread is put in place in relation thereto, the thread provides a constant pressure to aid in retaining the guide on the presser foot.

BRIEF DESCRIPTIONS OF THE INDIVIDUAL FIGURES OF THE DRAWINGS

FIG. 1 is a fragmentary view of a sewing machine to which the guide is applied.

FIG. 2 is a fragmentary top view of the prongs of the sewing machine taken at line 2—2 of FIG. 1.

FIG. 3 is an end view taken at line 3—3 of FIG. 1.

FIG. 4 is a view taken at line 4—4 of FIG. 1.

FIG. 5 is a perspective view of the thread guide of the invention.

FIG. 6 is a perspective view of the thread guide, but at an angle different from that of FIG. 5.

FIG. 7 is a side view of the thread guide, oriented according to line 4—4 of FIG. 1, but omitting the elements of FIG. 4 that are not included in the guide.

FIG. 8 is a top view of the thread guide, oriented according to line 8—8 of FIG. 1.

DETAILED DESCRIPTION

FIG. 1 shows a fragment of a sewing machine 10 having a needle 12 detachably mounted on a shaft 14. The shaft, and thus the needle, is mounted vertically, for vertical reciprocation as in known sewing machines. Hereinafter, the sewing machine and the thread guide are described as oriented in FIG. 1, with the needle disposed vertically.

The sewing machine has another vertical shaft 16 on which is detachably mounted a presser foot 18 of known kind. This shaft is adjustable vertically between an upper inactive position in which the presser foot is raised, and a lower active position in which the presser foot engages the base 22 of the sewing machine, or any material being sewed.

FIG. 2 shows this presser foot in top view, and it will be seen that it includes a pair of spaced prongs 20 disposed generally horizontally, with a space 21 therebetween. These prongs are not truly horizontal, since usually they are curved, but the shape and arrangement is such that they extend generally along the surface of the base 22 or bottom element of the sewing machine.

At the beginning of a stitching step, the operator adjusts the shaft 16 downwardly to position the presser foot in its lower, active position, and it remains in that position throughout a predetermined period of stitching. The needle 12 is arranged to extend through the space 21 of the presser foot. The operation of the needle and the presser foot does not require detailed description, and emphasis is placed on the construction of the thread guide itself, which is identified 24. In the description next following, it will be seen that the device is applied directly to the presser foot and supported thereby.

Reference is made to FIGS. 3 and 4 showing the thread guide 24 in its entirety, which is in the form of an attachment, as described in detail hereinbelow. The device includes a main body 26 and a guide pin 28. The main body includes a shank 30 and a pair of prongs 32.

When the device 24 is fitted on the prongs of the presser foot, the shank 30 extends generally upwardly, but at an oblique angle, and the prongs 32 extend generally horizontally. This main body is of a one-piece, integral construction, the shank being flat and blade-like, and the prongs, while extending generally horizontally, have a vertical dimension or extension 34 (FIG. 4), with a space 36 between the prongs. These prongs are parallel, having longitudinal groves 38, on the inner, or opposing, surfaces, the groves opening out through the free ends of the prongs.

The elements are so arranged, that the shank 30, and the prongs 32, lie in planes generally perpendicular to a line 40 about which the angle between the shank and the prongs is determined, thereby providing great strength in the appropriate direction for performing a secure guiding function when the device is applied to the sewing machine.

The 28 includes a central pin element 42 rigidly mounted on the shank 30 by suitable means indicated 44. A roller 46 is rotatably fitted on the pin element 42 and rotates to accommodate the thread which is guided around this roller.

To apply the guide to the sewing machine, the prongs 32 on the guide are moved longitudinally, to the right, FIG. 1, onto the prongs 20 of the presser foot. The outer free ends of the prongs 20 fit into the groves 38 in the guide prongs 32. The prongs 32 and the groves 38, are so dimensioned that the prongs 20 fit in the groves with a high friction fit, for holding the device in place. The guide attachment is applied by merely pushing it onto the presser foot, and removed by simply pulling it off. The thread guide is supported substantially entirely by the presser foot, although as referred to again hereinbelow, the thread in the sewing machine incidentally works in that direction also.

As indicated above, the presser foot is generally horizontal, and thereby the prongs 32 are generally horizontal, although not necessarily exactly so. The needle 12 is on a vertical axis line 48, and when it is reciprocated it passes through the space 21 in the presser foot, and thereby necessarily through the space 36 (FIG. 5) in the attachment. It will be observed that when the guide is applied, the pin is spaced horizontally a substantial distance from the needle, as shown by the spacing 49 in FIG. 1.

FIG. 1 shows the sewing thread 50, which is to be guided by the guide. This thread leads from a source indicated diagrammatically at 52 in a known manner in present sewing machines, and then it is wrapped over the pin 28 of the attachment, and specifically around the roller 46. This thread may be wrapped completely around the pin to assure its not being accidentally lifted off of the pin. The thread then leads to the needle at 54 and is threaded therethrough in the usual manner.

For convenience in referring to the assemblage of the needle, presser foot and thread guide, the needle and presser foot are at an inner end, and the upper end of the thread guide (pin 28) at an outer end.

The two lengths 50*a*, 50*b*, of the thread 30, at the pin 28, are held out away from the needle (FIG. 1) and this prevents that portion of the thread from being tangled or snagged by the needle. As will be understood, the thread, as it is being fed in a sewing step, as oriented in FIG. 1, is pulled away from the needle, to the right, by the material being sewed at the bottom of FIG. 1, and thereby the upper and lower lengths 50*a*, 50*b*, are taut. This pulling action to the right, on the thread in the sewing step, pulls the thread in the same direction, and thereby pulls the guide in the same direction, so that the guide is prevented from being dislodged, which would be to the left.

For convenience, and particularly in interpreting the claims, the presser foot prongs may be referred to as first prongs, and the thread guide prongs 32 as second prongs.

What is claimed is:

1. A thread guide for use with a sewing machine having an inner end and an outer end, and having a presser foot with a vertical segment and a generally horizontal segment at the lower end of the vertical segment, the horizontal segment having side edges and a free end, and having a central area with an opening for extension of a reciprocable vertical needle therethrough, the sewing machine also having such a needle, the sewing machine being operative for moving the material being sewed in a predetermined direction, the thread guide comprising, a unitary bracket adapted to be detachably mounted on the presser foot, the unitary bracket being referred to herein as oriented when so mounted, the bracket including, a foot element, a shank, and a pin, the foot element having gripping elements frictionally engaging the presser foot when the foot element is mounted on the presser foot and being thereby positioned substantially in horizontal position, the shank extending diagonally forwardly and upwardly, and the pin extending transversely from the shank at the upper end of the shank, whereby the continuous thread in the sewing machine can be wound around the pin at a position displaced a substantial distance horizontally from the end of the needle in direction opposite the direction of movement of the material being sewed.

2. A thread guide according to claim 1 wherein the horizontal segment of the presser foot includes a pair of spaced first prongs, and the gripping elements in engaging the presser foot so engage it by engaging the outer edges of the first prongs, and the thread guide is thereby supported by the presser foot.

3. A thread guide according to claim 2 wherein, the foot element includes second prongs that constitute said gripping elements.

4. A thread guide according to claim 3 wherein, the second prongs have longitudinal groves on their interfacing surfaces, adapted to receive the first prongs.

5. A thread guide according to claim 1 wherein, the thread guide includes a rotatable roller, and the thread guide, except for the roller, is of integral rigid construction.

* * * * *